United States Patent [19]

Morrow, Sr.

[11] 4,131,078

[45] Dec. 26, 1978

[54] COLLAPSIBLE CRANE BACKHITCH AND OVERLOAD SIGNAL SYSTEM

[75] Inventor: James G. Morrow, Sr., Manitowoc, Wis.

[73] Assignee: The Manitowoc Company, Inc., Manitowoc, Wis.

[21] Appl. No.: 792,100

[22] Filed: Apr. 29, 1977

[51] Int. Cl.[2] ..... G08B 07/04

[52] U.S. Cl. ..... 116/4; 116/124 F; 212/39 MS; 214/761

[58] Field of Search ..... B60C/13/16; 116/124 F, 116/4; 212/39 MS, 39 A; 188/1 C

[56] References Cited

U.S. PATENT DOCUMENTS

| | | | |
|---|---|---|---|
| 2,703,180 | 3/1955 | Brown | 212/58 R |
| 3,079,080 | 2/1963 | Mason | 116/124 F X |
| 3,087,584 | 4/1963 | Jackson et al. | 188/1C |
| 3,132,721 | 5/1964 | Jackson | 188/1 C |
| 3,638,211 | 1/1972 | Sanchez | 73/141 A |
| 3,924,752 | 12/1975 | Hoofnagle | 212/39 MS |
| 4,058,178 | 11/1977 | Shinohara et al. | 212/39 MS X |

*Primary Examiner*—Daniel M. Yasich

*Attorney, Agent, or Firm*—Leydig, Voit, Osann, Mayer & Holt, Ltd.

[57] ABSTRACT

An energy absorbing backhitch for a lift crane including a hollow deformable element which is collapsed between squeeze rollers when the crane is over loaded a predetermined amount with respect to its rated capacity. The backhitch also includes a lift pin and means for sensing deflection of the lift pin and actuating visual and audio signals at predetermined load conditions.

8 Claims, 9 Drawing Figures

22
18
52
10
18
21
23
16
20
53
19
54
41
26
26
34
43
17
33
14
13
42
37
51
49
39
31
38
48
30
32
12
11

COLLAPSIBLE CRANE BACKHITCH AND OVERLOAD SIGNAL SYSTEM

The present invention relates generally to load handling cranes and more particularly concerns a collapsible backhitch and overload warning signals for such cranes.

Load lifting cranes are sold to work within certain rated capacities established by the crane manufacturer. The cranes are built with a predetermined safety factor e.g. they may be designed to withstand a loading equal to twice the rated capacity. It is also known that crane operators sometimes lift or attempt to lift loads greater than the rated capacity of the crane and occasionally in excess of the actual capacity of the crane, even when the built-safety factor is taken into account.

Accordingly, it is the primary aim of the present invention to provide an overload signal system for a load lifting crane which provides a warning signal when the rated capacity of the crane is approached and/or exceeded. It is a more detailed object to provide a visual warning signal to the crane operator just before the crane's rated capacity is exceeded and to provide an audible warning signal to those in the immediate vicinity of the crane when it is loaded above its rated capacity. A related object is to provide that the audible warning signal increases in intensity as the overload condition increases.

Another important object of the invention is to provide a mechanism with a predetermined yield which will release prior to structural failure of other components of the crane when subjected to an extreme overload condition. A related and more specific object is to provide a collapsible backhitch mechanism with predetermined yield characteristics which will progressively release before boom failure when subjected to severe overload conditions.

Other objects and advantages of the invention will become apparent upon reading the following detailed description and upon reference to the drawings, in which:

FIG. 1 is a fragmentary side elevation of a lift crane embodying the present invention;

FIGS. 2 and 3, respectively, are enlarged, fragmentary side and rear elevations of one of the collapsible backhitch mechanisms of the invention;

While the invention will be described in connection with certain preferred embodiments and procedures, it will be understood that I do not intend to limit the invention to those specific embodiments and procedures. On the contrary, I intend to cover all alternatives, modifications and equivalents as may be included within the spirit and scope of the invention as defined by the appended claims.

Figure 1:
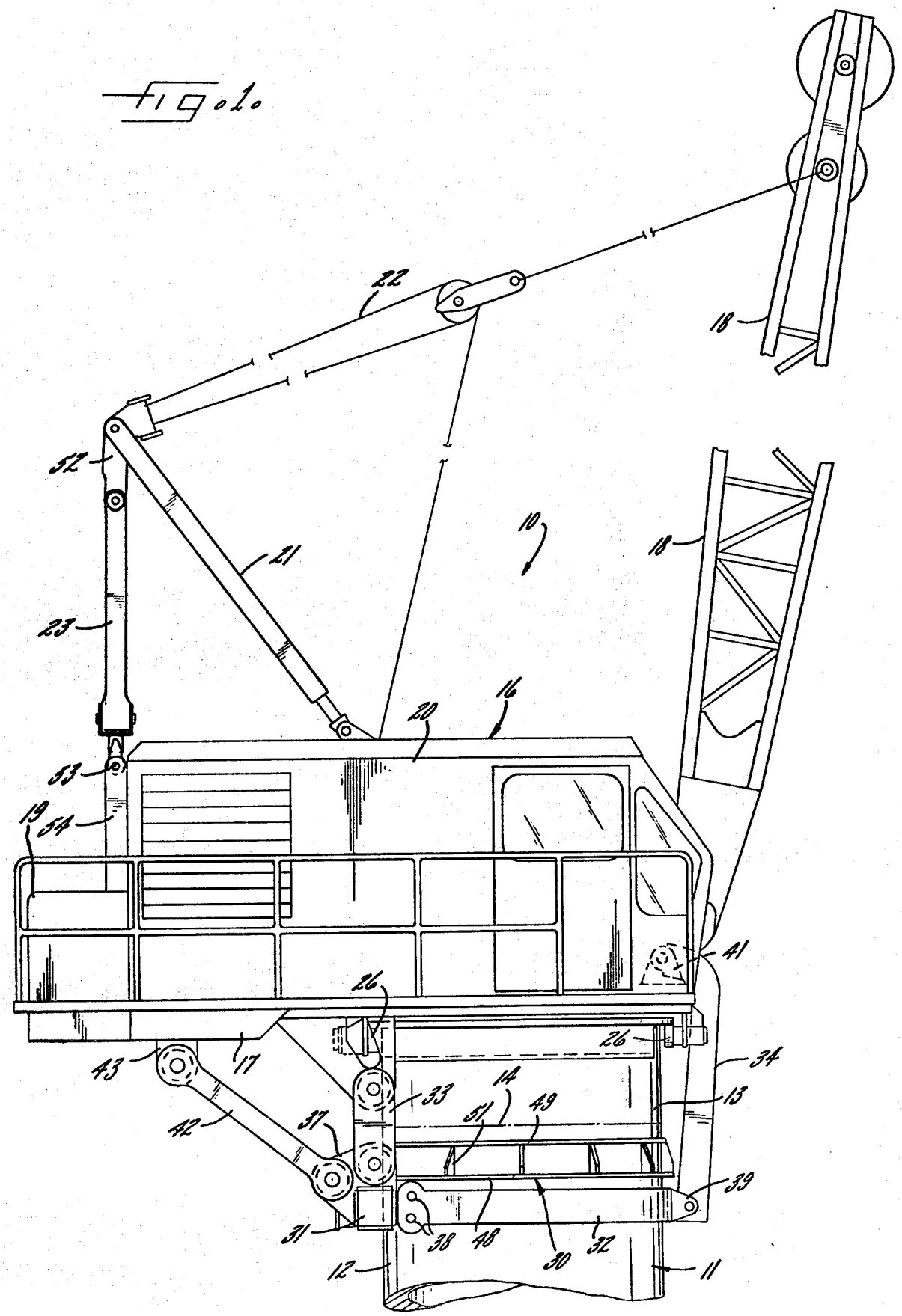

Turning now to the drawings, there is shown in FIG. 1 a lift crane 10 mounted on a cylindrical pedestal 11 formed of a lower part 12 constituting an element of the base structure, such as an offshore drilling platform, and an upper part 13 joined integrally with the lower part along a generally horizontal weld line 14. Typically, the crane manufacturer would supply the crane 10 down to and including the upper pedestal part 13 so that the crane is installed by welding the parts 12 and 13 along the weld line 14. It will be understood, however, as the description proceeds, that the present invention is not limited to pedestal mounted cranes, but may be applied to other crane configurations such as self-propelled or gantry mounted cranes.

The crane 10 includes upper works 16 having a bed 17 carrying a boom 18 at one end and supporting a counterweight 19 at the other end. A machinery house 20 is also carried on the bed 17, and a gantry 21, boom rigging 22 and a novel backhitch 23, to be described hereafter, are provided. The bed 17 is rotatably mounted on a roller path 25 fixed at the top of the upper pedestal part 13 and, as is conventional, hook rollers 26 are mounted on the bed 17 so as to engage the underside of the roller path 25 and hold the crane down against the roller path.

As mentioned above, lift cranes are sometimes subjected to severe overloads which could cause structural failures including, in an extreme case, toppling the entire crane 10 from the pedestal 11. To prevent that type of catastrophic failure, the crane illustrated may be provided with a tiedown arrangement such as disclosed in U.S. Pat. No. 4,011,955. and assigned to the same assignee as the present invention. Briefly, such a tiedown includes an annular collar 30 fixed around the pedestal 11 well below the roller path 25, and an arcuate stop bar 31 and a strap 32 anchored at its ends to the ends of the stop bar 31 are suspended by tension links to embrace the pedestal 11 and hang beneath the collar 30 but out of contact with both the pedestal and the collar. Preferably, the stop bar 31 is a heavy beam-like structure held on the side of the pedestal 11 opposite the boom 18 by a pair of double tension links 33 extending from lugs 36 on the bed 17 to lugs 37 on the bar 31. The strap 32, anchored to the bar 31 by pins 38 is suspended by a pair of double tension links 34 pinned to lugs 39 on the strap and hooked over to be pinned to lugs 41 on the bed 17 adjacent the foot of the boom 18.

To prevent that form of failure in which the counterweight carrying end of the bed 17 bends upwardly, an additional pair of double tension links 42 extend from the stop bar lugs 37 to lugs 43 at the rear or counterweight end of the bed 17. So as to avoid a catastrophic failure as a result of separation of the pedestal parts along the weld line 14, the collar 30 is located below that weld line. Preferably, the collar 30 itself consists of a weldment made up of a pair of spaced annular rings 48 and 49 reinforced and stiffened by a plurality of ribs 51.

In accordance with the present invention, an overload warning signal system is provided to cooperate with the backhitch 23 which has energy absorbing capabilities. As shown in FIG. 1, the backhitch 23 is pinned at its upper end to links 52 connected to the upper end of the gantry 21 and is connected at its lower end by a lift pin 53 to brackets 54 secured to the bed 17. In practice, the bakhitch mechanism may include a pair of backhitches 23 spaced laterally apart at the rear of the crane. However, for the purposes of illustration, only a single backhitch mechanism 23 is shown in the subsequent drawings.

Figure 2:
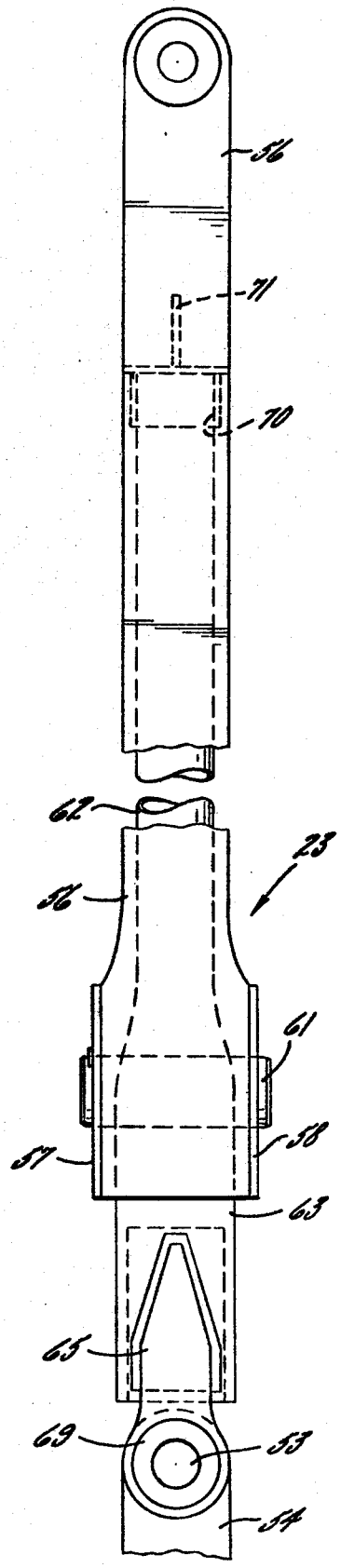
Figure 3:
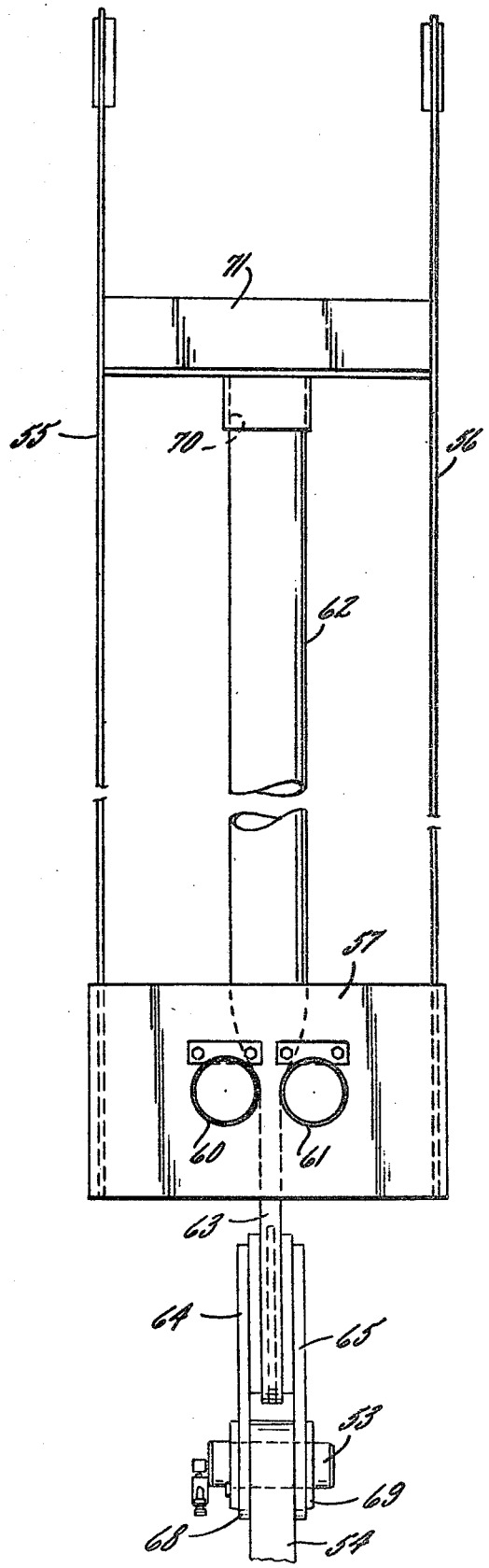

Turning now to FIGS. 2 and 3, each backhitch 23 includes an upper frame having spaced-apart links 55 and 56 joined at the bottom by plates 57 and 58 which carry a pair of rollers 60 and 61. A tubular element 62 is disposed between the links 55 and 56 and has a flattened lower end 63 fitted between the rollers 60, 61. A pair of plates 64 and 65 are secured to the flat end 63 of the tube 62 and the plates 64, 65 have apertures 65 and 67 surrounded by reinforcing collars 68 and 69 for receiving the lift pin 53. The upper end of the tube 62 is located in a socket 70 mounted on a cross frame 71 connected to the side links 55, 56.

Figure 4:
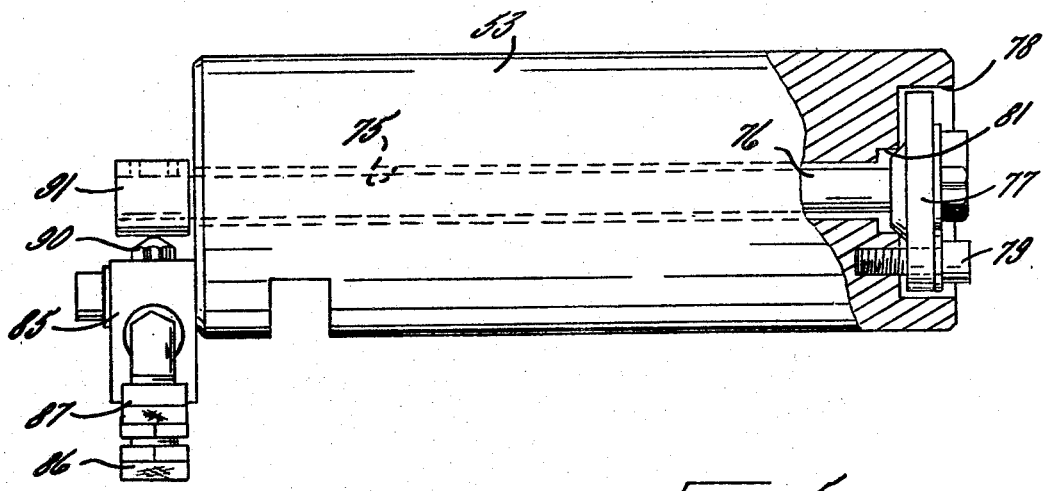
FIG. 4 is an enlarged, partially sectioned rear elevation of one of the backhitch lift pins and warning signal valves.
Figure 5:
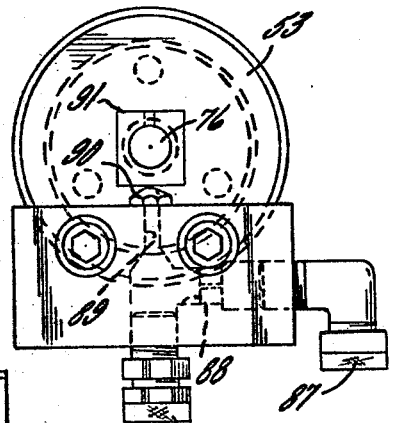
FIG. 5 is an end view of the lift pin and signal valve shown in FIG. 4.
Figure 6:
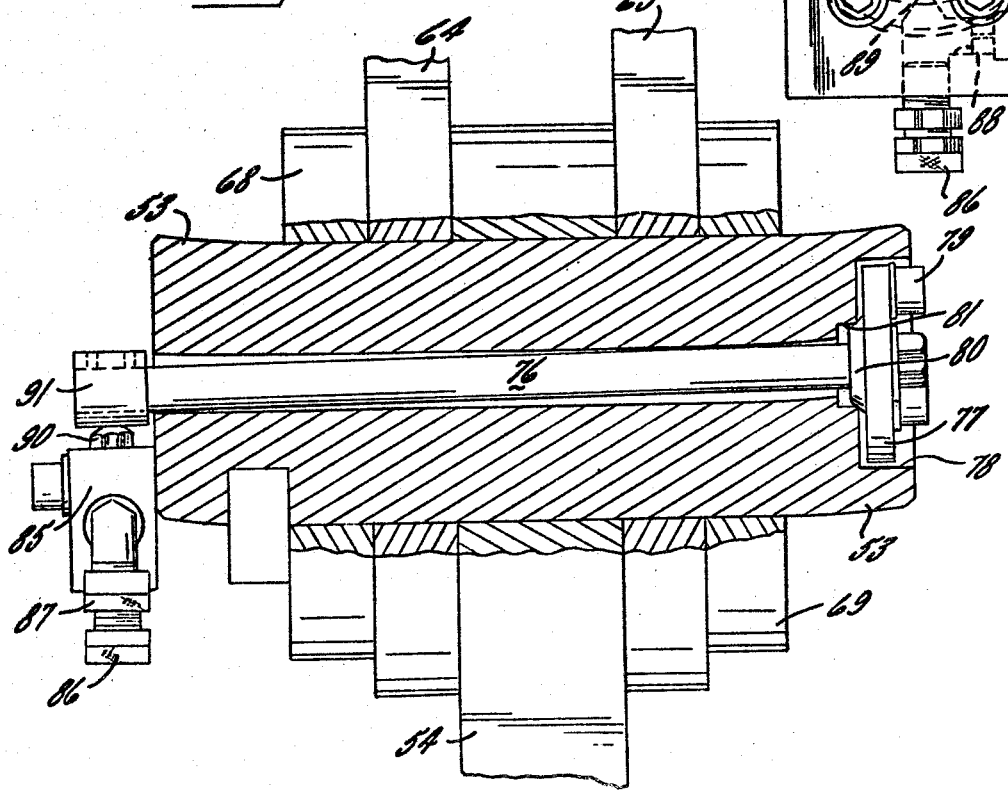
FIG. 6 is an exaggerated, fragmentary section of the backhitch and lift pin under a substantial overload condition.

Pursuant to one aspect of the invention, deflection of the lift pin 53, when the crane is lifting heavy loads, is used to trigger the overload warning system. As shown in FIGS. 4–6, the lift pin 53 has a hollow center bore 75 through which a control rod 76 extends. The control rod 76 is mounted in cantilever fashion on a plate 77 secured in a recess 78 at one end of the pin 53 by cap screws 79. Preferably, the plate 77 is formed with a tapered shoulder 80 dimensioned to partially enter a stepped recess 81 in the pin 53 for the purpose of centering the rod 76 in the bore 75 by adjusting the cap screws 79.

As a heavy load is lifted, tension in the backhitch 23 is transmitted through the plates 64, 65 to the lift pin 53 and frame bracket 54. Because the bracket 54 is located between the plates 64 and 65, the lift pin 53 deflects (i.e. bows down in the center as shown in exaggerated fashion in FIG. 6) when the crane is heavily loaded. As the pin 53 deflects (bows down) each end tilts inwardly adjacent its top (i.e. 12 o'clock position) and outwardly adjacent its bottom (i.e. 6 o'clock position). This relative tilting of the pin ends causes the rod 76, which is not loaded, to slant downward (from right to left as seen in FIG. 6).

To sense deflection of the lift pin 53 and thus the degree of loading on the crane, an air relief valve 85 is mounted on the end of the pin 53 opposite the plate 77. The valve 85 is provided with air inlet and outlet fittings 86 and 87 connected through an internal passage 88 to a relief passage 89. A relief orifice is formed in a nozzle head 90 screwed into the valve block so as to communicate with the passage 89. Above the relief orifice the rod 76 carries a flapper block or arm 91 which engages the nozzle head when the lift pin is deflected due to a heavy load on the crane.

Air is supplied to the relief valve 85 from a suitable source (see FIG. 7) preferably at a regulated constant pressure and is normally bled out through the relief passage 89 and orifice nozzle 90. When the crane is loaded, the lift pin deflects and the flapper block 91 begins to throttle the relief orifice. This increases the pressure delivered to the outlet fitting 87.

Figure 7:
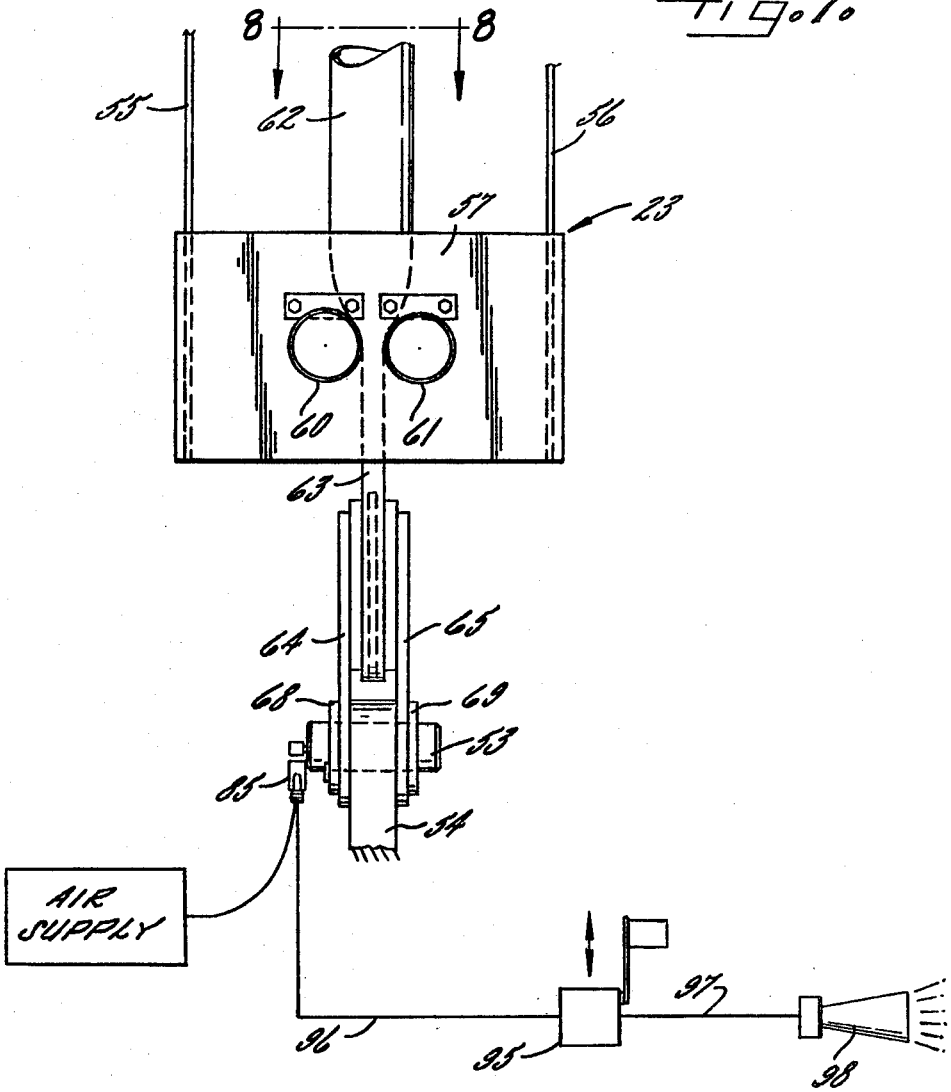
FIG. 7 is a fragmentary rear elevation of a portion of the backhitch and lift pin connection with a schematic circuit for the overload warning signal system of the invention.
Figure 8:
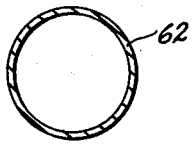
FIG. 8 is an enlarged, fragmentary section as seen substantially along line 8—8 in FIG. 7; and, FIG. 9 is a section similar to FIG. 8 showing a modification with concentric tubes, one inside the other.

In the preferred embodiment, the overload warning system of the present invention includes both visual and audio signal devices. As shown in FIG. 7, a visual signal device in the form of an air actuated flag 95 is connected to the outlet fitting 87 by a conduit 96. Another section of conduit 97 delivers air from the relief valve 85 to an air horn 98. The flag is preferably mounted in the crane operator's cab, but the air horn is preferably mounted externally so it may be easily heard by those working around the crane.

In operation, when the crane is loaded to a predetermined amount, e.g. at 90% of rated capacity, the pin deflection will cause the flapper block 91 to throttle the relief orifice sufficient to cause the visual flag to be actuated. This signal notifies the crane operator that the load is very near the crane's rated capacity. If the loading continues to increase, e.g. at 105% of rated capacity the relief orifice is further throttled causing the signal horn to operate in short blasts. Each blast or pulse of the horn relieves some of the pressure in the line 97, which must build up for the next blast. As the loading continues to increase, the frequency of the horn blasts increases until it is sounding continuously at, for example, 175% of rated capacity.

Pursuant to another aspect of the invention the tubular elements 62 in the backhitch 23 are selected so that they will begin to collapse between the rollers 60 and 61 at a predetermined crane loading, for example, at 175% of rated capacity. This squeezing or flattening of the tube 62 also absorbs energy and provides a controlled length for the backhitch to extend before it is released. Also as the signal horn begins to blow continuously, the crane operator (and others) are alerted that the crane's rated capacity has been greatly exceeded and the backhitch is about to begin stripping. Thus, suitable corrective and/or safety measures should be taken immediately.

In the preferred embodiment, the deformable tubular element 62 is a cylindrical steel tube, however, it could also be made of other materials which are permanently deformable.

Figure 9:
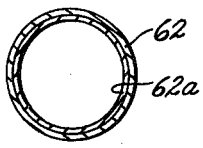

Although only a single tube 62 has been shown in FIGS. 2, 3, 7 and 8 for each backhitch assembly 23, it will be appreciated that multiple tubes 62 and 62*a* could be employed, for example one tube inside another as shown in FIG. 9. Also, the tube wall section could be increased in stages from bottom to top in order to cause it to collapse at progressively higher loadings in somewhat of a stepping fashion.

I claim as my invention:

1. An energy absorbing backhitch for a lift crane having a load handling boom supported by rigging connected to the backhitch mounted adjacent the rear end of the crane comprising, in combination, means including a lift pin for connecting said backhitch to said crane and means including an air source for detecting deflection of said lift pin when said crane is loaded, said detecting means including an air valve connected to said source and said lift pin including a flapper arm for throttling said valve upon deflection of said lift pin, said backhitch including upper and lower connecting sections one of which carries a pair of squeeze rollers, and a hollow deformable element having a flattened end projecting between said rollers and connected to said other section, said hollow element being permanently collapsed and flattened between said rollers when a predetermined tension load is applied to said backhitch tending to pull said upper and lower sections apart.

2. The combination defined in claim 1 wherein said hollow element is a cylindrical steel tube.

3. The combination defined in claim 2 wherein said hollow element includes concentrically mounted tubular elements.

4. The combination defined in claim 3 wherein said concentrically mounted elements progressively increase the wall thickness in the direction extending away from said rolls.

5. The combination defined in claim 1 wherein said lift pin includes a hollow bore and said flapper arm is in the form of a rod mounted in cantilever fashion in said bore from one end of said lift pin.

6. The combination defined in claim 5 wherein said valve is mounted on the other end of said lift pin and includes a discharge orifice disposed adjacent the free end of said rod.

7. The combination defined in claim 1 including a visual indicator connected to said valve and operable thereby when said crane loading approaches its rated capacity.

8. The combination defined in claim 1 including an air horn connected to said valve and operable thereby when said crane loading exceeds its rated capacity by a predetermined amount causing said horn to pulsate and said pulsations increasing in frequency until said horn sounds continuously at a higher overload condition.

* * * * *